US007854186B2

(12) United States Patent
Wu

(10) Patent No.: US 7,854,186 B2
(45) Date of Patent: Dec. 21, 2010

(54) TOOLS FOR REMOVING HOUSE FROM OBJECT

(76) Inventor: Pi-Liang Wu, P.O. Box 55-124, Taichung (TW)

( * ) Notice: Subject to any disclaimer, the term of this patent is extended or adjusted under 35 U.S.C. 154(b) by 253 days.

(21) Appl. No.: 12/232,625

(22) Filed: Sep. 22, 2008

(65) Prior Publication Data

US 2010/0011917 A1 Jan. 21, 2010

(30) Foreign Application Priority Data

Jul. 17, 2008 (TW) ..... 97212731 U

(51) Int. Cl.
*B25B 13/30* (2006.01)
*B25B 7/04* (2006.01)

(52) U.S. Cl. ..... 81/395; 81/118

(58) Field of Classification Search ..... 81/395, 81/381, 382, 384–386, 397–399, 401–404, 81/118; 269/239, 247
See application file for complete search history.

(56) References Cited

U.S. PATENT DOCUMENTS

| | | | | |
|---|---|---|---|---|
| 338,326 | A * | 3/1886 | Wilson | 81/382 |
| 1,105,473 | A * | 7/1914 | Walker | 269/239 |
| 1,709,589 | A * | 4/1929 | McKibbon | 81/118 |
| 1,782,752 | A * | 11/1930 | Weisler | 81/118 |
| 6,813,976 | B2 * | 11/2004 | Malvini et al. | 81/300 |

* cited by examiner

*Primary Examiner*—David B Thomas

(57) ABSTRACT

A tool for removing hose from objects includes a handle having a first jaw fixed to the handle and a second jaw which is movably connected to the first jaw in a scissors-like way. The first and second jaws have two respective clamp portions so as to clamp the hose. An adjustment unit includes a first member pivotably connected to the first jaw and a second member pivotably connected to the second jaw. A bolt threadedly extends through the first and second members such that when rotating the bolt, the two clamp portions are moved toward each other. An operation unit includes a cable and a bar connected to the cable. The tool is pulled along the object on which the hose is connected by pulling the cable.

15 Claims, 4 Drawing Sheets

TOOLS FOR REMOVING HOUSE FROM OBJECT

FIELD OF THE INVENTION

The present invention relates to a hand tool, and more particularly, to a hose removing tool for removing hoses from objects of vehicles.

BACKGROUND OF THE INVENTION

A conventional connection between the engine and air filter of vehicles includes a hose having two ends which are connected to the inlet of an engine and an air filter, such that air is filtered when passing through the air filter and supplied into the combustion chamber of the engine. The hose usually is made by rubber which is flexible and can be easily bent in the limited space in the engine room.

The engine generates heat which is supposed brought from the engine by the coolant and the radiator. However, the temperature in the engine room is high and accelerates the rubber hose to reach its fatigue limit. The hose might become fragile and cracked, so that the hose has to be replaced to prevent leakage.

The two ends of the hose on the engine and the air filter become sticky and cannot be removed from the engine and the air filter easily. Generally, the technician uses a knife or a thin object to insert between the object and the end of the hose, and then separates the hose from the objects. The hose is then pulled and separated from the objects.

The engine room has limited space which restricts the use of tools so that it takes a lot of time to remove the hose from the engine and the air filter.

The present invention intends to provide a tool for removing the hose from the objects such as the engine and the air filter conveniently.

SUMMARY OF THE INVENTION

The present invention relates to a tool for removing hose from objects and comprises a handle, a first jaw and a second jaw are connected to the handle, an adjustment unit and an operation unit. The first jaw has a first clamp portion and a fixed portion which is fixed to the handle, the first clamp portion including bosses extending from an inside thereof. The second jaw has a second clamp portion and a pivotable portion which is movably connected to the handle, the second clamp portion include bosses extending from an inside thereof. The pivotable portion movably extends through the fixed portion at an angle to arrange the first and second bosses to face each other.

The adjustment unit includes a first member pivotably connected to the fixed portion of the first jaw and a second member pivotably connected to the pivotable portion of the second jaw. A bolt threadedly extends through the first and second members, the first and second clamp portions move toward each other when rotating the bolt in a first direction and away from each other when rotating the bolt in a second direction.

The operation unit includes a cable and a bar, the cable having a first end connected to the handle and a second end of the cable is connected to the bar.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
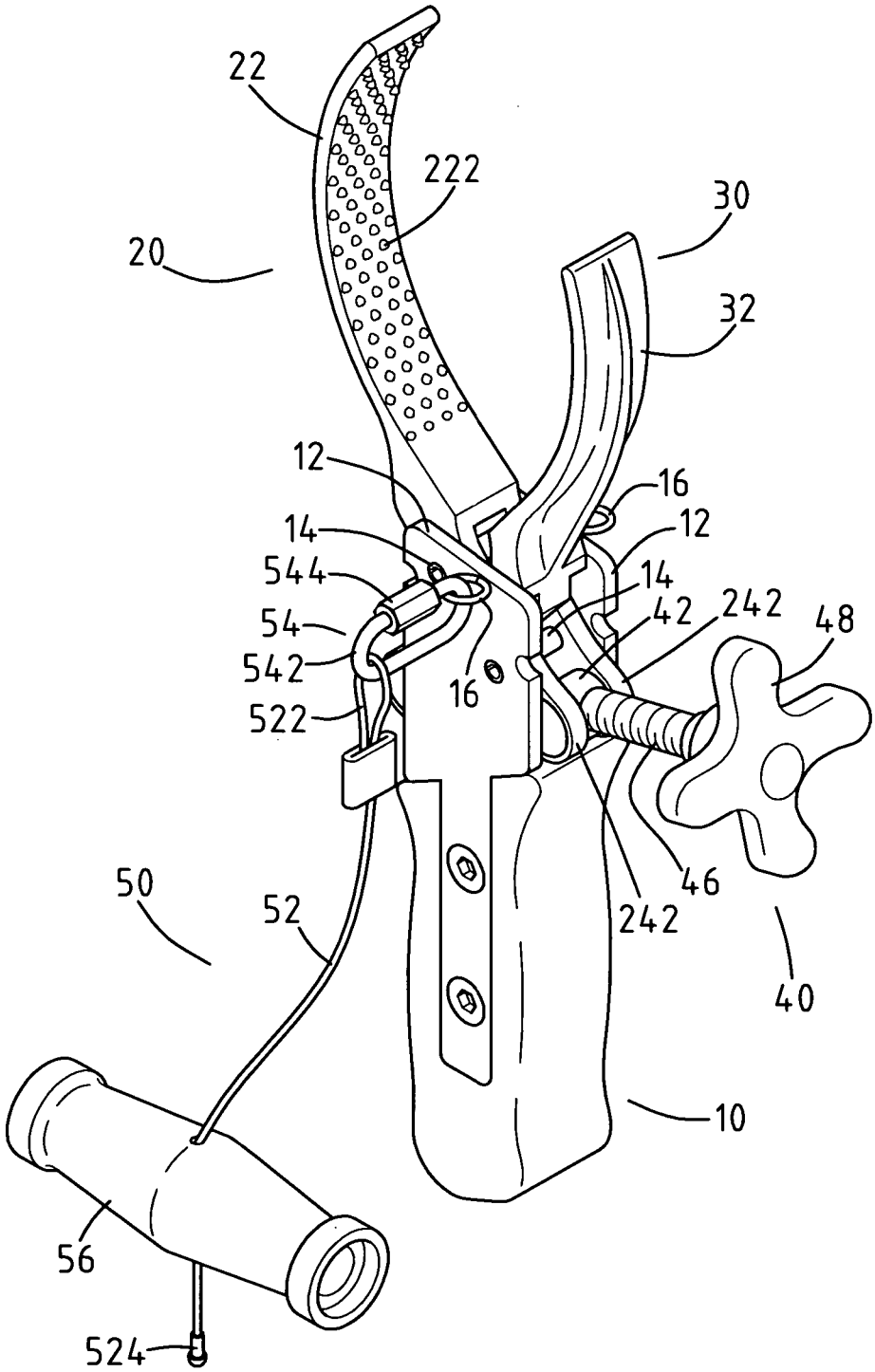
FIG. 1 is a perspective view to show the tool of the present invention.
Figure 2:
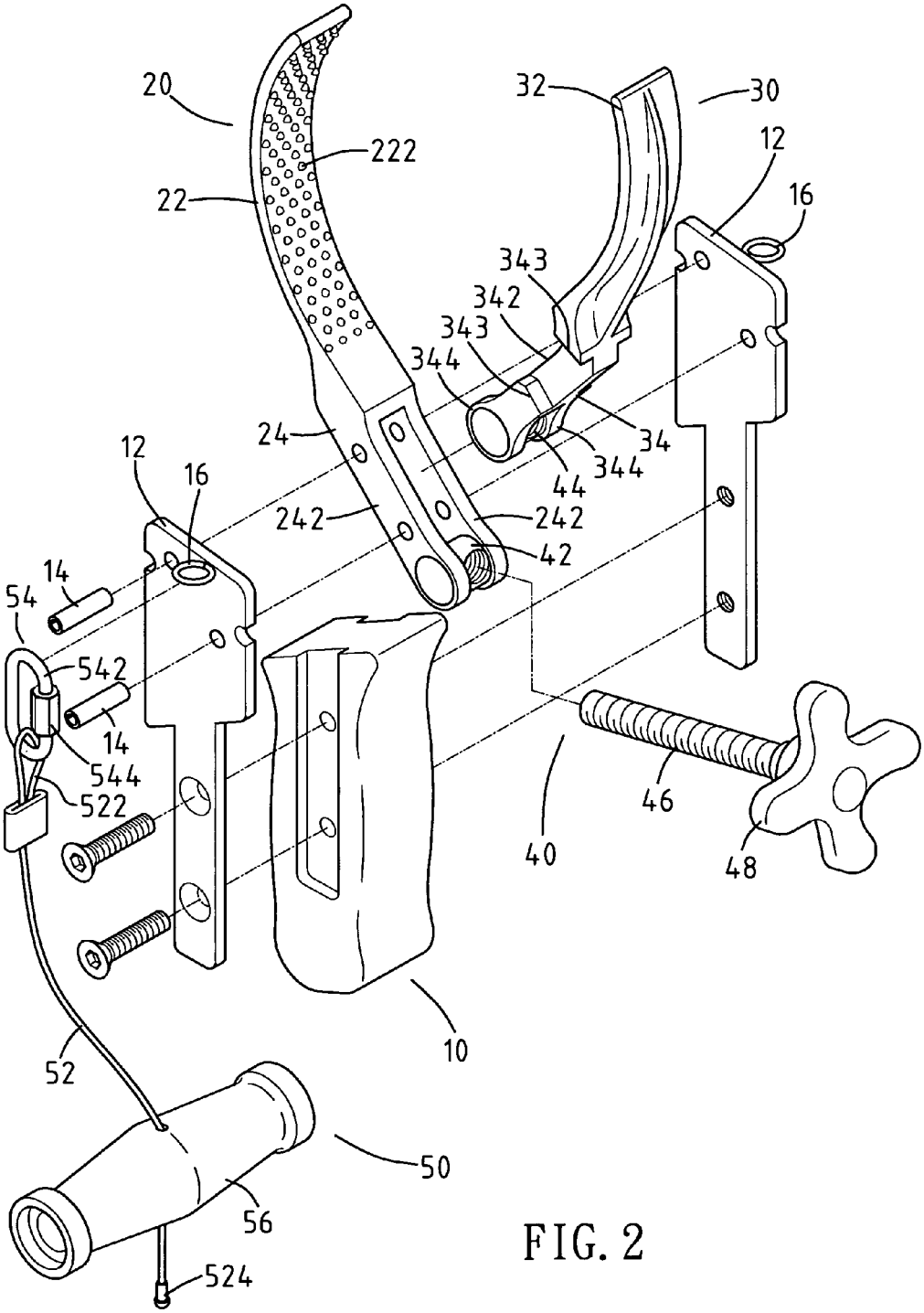
FIG. 2 is an exploded view to show the tool of the present invention.
Figure 3:
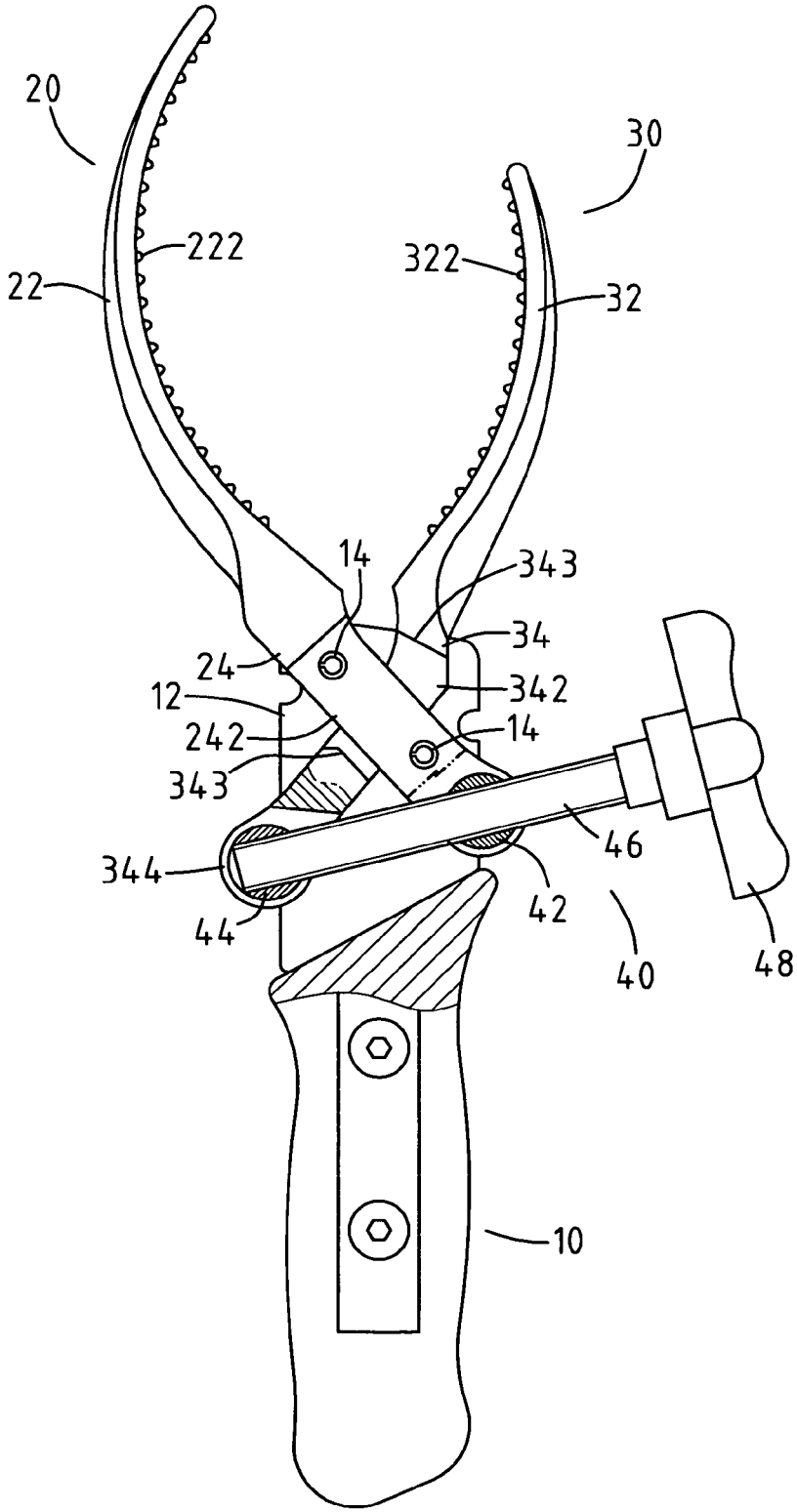
FIG. 3 is a partial cross sectional view of the tool of the present invention.

Referring to FIGS. 1 to 3, the tool for removing hose from objects of the present invention comprises a handle 10 including two boards 12 on two sides thereof and a gap is defined between the two boards 12 extending from an end of the handle 10. First and second jaws 10, 20 are located between the two boards 12. Two rings 16 are on two respective outsides of the two boards 12. The first jaw 20 includes a first clamp portion 22 and a fixed portion 24 which is fixed to the handle 10. The fixed portion 24 includes two parallel plates 242 and a first member 42 is pivotably connected between the two plates 242. The first member 42 includes a through hole. The fixed portion 24 is fixed to the boards 12 of the handle 10 by extending two pins 14 through the two boards 12 and the fixed portion 24. The first clamp portion 22 includes a curved surface defined in an inside thereof and bosses 222 extend from the curved surface.

The second jaw 30 includes a second clamp portion 32 and a pivotable portion 34 which extends between the two plates 242 of the fixed portion 24 at an angle so that the pivotable portion 34 is movably connected to the handle 10. The second clamp portion 32 includes a curved surface defined in an inside thereof and bosses 322 extend from the curved surface. The first and second jaws 20, 30 are arranged in scissors-like way to let the first and second bosses 222, 322 face each other.

The pivotable portion 34 includes two lugs 344 and a second member 44 is pivotably connected between the two lugs 344. The second member 44 includes a threaded hole. Two recesses 342 are defined in two respective outsides of the two sides of the pivotable portion 34. Each recess 32 is located between two stops 343 on the pivotable portion 34. The two plates 242 are movably engaged with the two recesses 342 and stopped by the stops 343 so as to position the pivotable portion 34.

An adjustment unit 40 includes a bolt 46 which has a first end threadedly extends through the two respective threaded holes in the first and second members 42, 44, and a head 48 is connected to a second end of the bolt 46. The user can easily rotate the bolt 46 by operation of the head 48. The first and second clamp portions 22, 32 move toward each other when rotating the bolt 46 in a first direction and away from each other when rotating the bolt 46 in a second direction.

An operation unit 50 includes a cable 52 and a bar 56, the cable 52 has a loop 522 formed at a first end thereof and connected to a collar 54. The collar 54 includes a C-shaped body 542 and a locking member 544 is threadedly connected between two ends of an opening of the C-shaped body 542 so as to open or close the opening of the C-shaped body 542. A second end of the cable 52 extends through the bar 56 which is stopped by an enlarged piece 524 connected to the distal end of the second end of the cable 52 so that the bar 56 cannot disengage from the cable 52 and can freely moved toward the first end of the cable 52. The collar 54 is connected to one of the two rings 16 as needed.

Figure 4:
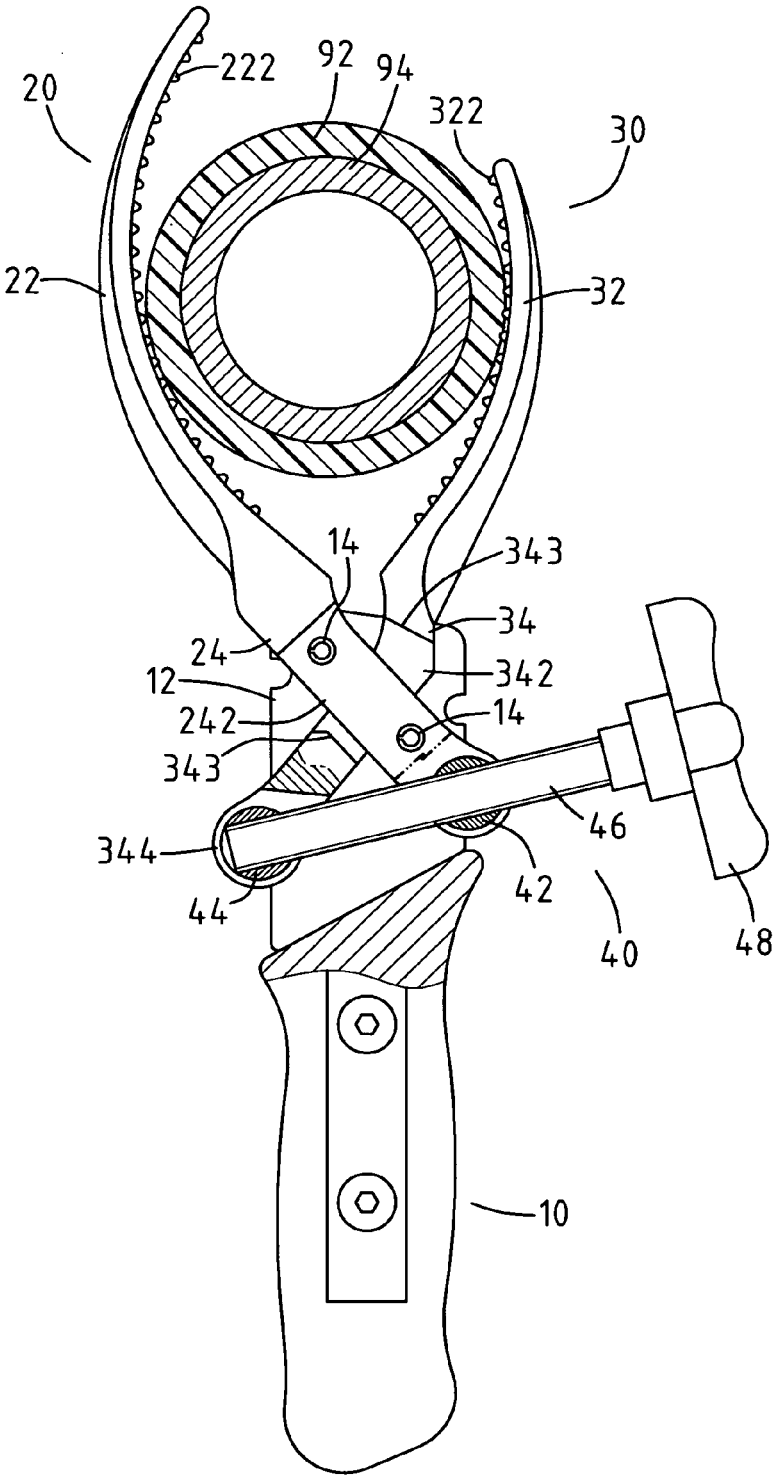
FIG. 4 shows that the hose is clamped between the two clamp portions of the tool of the present invention.

As shown in FIG. 4, the hose 92 is mounted to the object 94 and the user can operate the tool to clamp the hose 92 between the first and second clamp portions 22, 32 by rotating the bolt 46. The bosses 222, 322 provide proper friction between the tool and the hose 92. The user rotates the tool reciprocally to loosen the hose 92 relative to the object 94 so that no sticky portions are existed between the hose 92 and the object 94. The user then hook the collar 54 to either one of the two rings 16 on the boards 12, and pulls the bar 56 along the axis direction of the object 94 to remove the hose 92 from the object 94. The cable 52 allows the user to move the tool at a distance and does not restricted by the limited space in the engine room. The two rings 16 on the two boards 12 allow the user to pull the hose 92 in different directions.

The tool of the present invention can be moved by using the cable 52 and the bar 56 from a distance so that the user's hand does not restricted by the limited space. This makes the operation of removing the hose 92 more easily than the conventional ways.

While we have shown and described the embodiment in accordance with the present invention, it should be clear to those skilled in the art that further embodiments may be made without departing from the scope of the present invention.

What is claimed is:

1. A tool for removing hose from objects, comprising:

a handle;

a first jaw having a first clamp portion and a fixed portion which is fixed to the handle, the first clamp portion including bosses extending from an inside thereof;

a second jaw having a second clamp portion and a pivotable portion which is movably connected to the handle, the second clamp portion including bosses extending from an inside thereof, the pivotable portion movably extending through the fixed portion at an angle to arrange the first and second bosses to face each other;

an adjustment unit including a first member pivotably connected to the fixed portion of the first jaw and a second member pivotably connected to the pivotable portion of the second jaw, a bolt threadedly extending through the first and second members, the first and second clamp portions moving toward each other when rotating the bolt in a first direction and away from each other when rotating the bolt in a second direction, and an operation unit including a cable and a bar, the cable having a first end connected to the handle and a second end of the cable connected to the bar which is stopped at a distal end of the second end of the cable and freely moved toward the first end of the cable.

2. The tool as claimed in claim 1, wherein the bolt has a first end threadedly connected to the second member and a head is connected to a second end of the bolt.

3. The tool as claimed in claim 1, wherein the pivotable portion includes two lugs and the second member is pivotably connected between the two lugs.

4. The tool as claimed in claim 1, wherein the fixed portion includes two plates and the pivotable portion extends between the two plates.

5. The tool as claimed in claim 4, wherein two recesses are defined in two respective outsides of the two sides of the pivotable portion, each recess is located between two stops on the pivotable portion, the two plates are movably engaged with the two recesses and stopped by the stops so as to position the pivotable portion.

6. The tool as claimed in claim 4, wherein the first member is pivotably connected between the two plates.

7. The tool as claimed in claim 1, wherein the handle includes two boards and the first and second jaws are located between the two boards.

8. The tool as claimed in claim 7, wherein two pins extend through the boards and the fixed portion to fix the fixed portion to the two boards.

9. The tool as claimed in claim 1, wherein two rings are located on two sides of the handle and the operation unit is connected to one of the two rings.

10. The tool as claimed in claim 7, wherein two rings are on the two boards and the operation unit is connected to one of the two rings.

11. The tool as claimed in claim 9, wherein the cable includes a collar which is connected to one of the two rings.

12. The tool as claimed in claim 11, wherein the cable includes a loop which is connected to the collar.

13. The tool as claimed in claim 11, wherein the collar includes a C-shaped body and a locking member is threadedly connected between two ends of an opening of the C-shaped body so as to open or close the opening of the C-shaped body.

14. The tool as claimed in claim 11, wherein an enlarged piece is connected to the distal end of the second end of the cable so as to prevent the bar from disengaging from the cable.

15. The tool as claimed in claim 1, wherein the first and second clamp portions each include a curved surface defined in the inside thereof and the bosses extend from the curved surfaces.

* * * * *